United States Patent [19]

Kidon

[11] Patent Number: 4,497,876

[45] Date of Patent: Feb. 5, 1985

[54] CORROSION RESISTANT METAL COMPOSITE WITH ZINC AND CHROMIUM COATING

[76] Inventor: William E. Kidon, 12444 Pearl Rd., Chardon, Ohio 44024

[21] Appl. No.: 475,735

[22] Filed: Mar. 16, 1983

[51] Int. Cl.[3] ..... C25D 5/12

[52] U.S. Cl. ..... 428/624; 148/6.2; 148/6.16; 428/621; 428/632; 428/557; 428/658; 428/328; 204/28; 204/40; 204/407

[58] Field of Search ..... 428/624, 328, 621, 632; 148/6.2, 6.16, 62; 204/40, 28, 407

[56] References Cited

U.S. PATENT DOCUMENTS

| | | | |
|---|---|---|---|
| 2,419,231 | 4/1947 | Schantz | 428/658 |
| 3,382,081 | 5/1968 | Cutter et al. | 148/6.2 |
| 3,420,754 | 1/1969 | Roehl | 204/28 |
| 3,535,167 | 10/1970 | deRidder et al. | 148/6.2 |
| 3,535,168 | 10/1970 | Thompson | 148/6.2 |
| 3,671,331 | 6/1972 | Malkin et al. | 148/6.2 |
| 3,679,493 | 7/1972 | Beiswanger et al. | 148/6.16 |
| 3,687,739 | 8/1972 | Kennedy et al. | 148/6.2 |
| 3,838,495 | 10/1974 | Kuhnert | 29/458 |
| 4,079,163 | 3/1978 | Tanaka et al. | 428/328 |
| 4,216,272 | 8/1980 | Clauss | 428/632 |
| 4,282,073 | 8/1981 | Hirt et al. | 204/28 |
| 4,314,893 | 2/1982 | Clauss | 204/40 |
| 4,374,902 | 2/1983 | Smith | 428/621 |
| 4,407,900 | 10/1983 | Kirihara et al. | 428/659 |

FOREIGN PATENT DOCUMENTS

| | | |
|---|---|---|
| 56-113387 | 2/1980 | Japan . |
| 57-126977 | 8/1982 | Japan . |
| 57-185,987 | 11/1982 | Japan . |
| 58-022391 | 2/1983 | Japan . |
| 58-096893 | 6/1983 | Japan . |
| 58-164794 | 9/1983 | Japan . |
| 57-174469 | 10/1983 | Japan . |

*Primary Examiner*—Veronica O'Keefe
*Attorney, Agent, or Firm*—John J. Freer

[57] ABSTRACT

A metal composite is provided extended corrosion resistance. Prior to joining the metals of the composite, at least one of the metals is provided with a metallic undercoat. This undercoat is then coated with a metallic zinc layer. Lastly, a heat curable and substantially resin free topcoat is established on the zinc layer and cured. The topcoat composition contains chromium in non-elemental form and may further contain particulate metal, all in liquid medium. The metal composite is then formed by contacting metals including the thus coated metal. In addition to outstanding corrosion resistance, the composite can retain substrate weldability while further enhancing weatherability.

13 Claims, No Drawings

CORROSION RESISTANT METAL COMPOSITE WITH ZINC AND CHROMIUM COATING

BACKGROUND OF THE INVENTION

The tendencies of iron or steel surfaces to corrode is well known. Zinc is one of the most widely used metallic coatings applied to steel surfaces to protect them from corrosion. In the past, the principal methods of applying such coatings were hot-dipping, also known as galvanizing and the electroplating of a zinc layer onto the steel. Zinc has been electroplated on the steel surfaces from various plating baths, preferably from acid plating baths, for providing protection of steel surfaces for various uses.

It has been known as in the U.S. Pat. No. 2,419,231 to improve the corrosion resistance of the coating layer by using for the coating an alloy high in zinc and low in nickel. This alloy is co-deposited from the electrolytic plating bath onto the steel substrate. Continuous steel strip, alloy-plated in accordance with the teachings of the patent, when subjected to forming and finishing operations, tends to form cracks in the coating because of the brittleness of the alloy. However, subsequent improvements, as in U.S. Pat. No. 3,420,754 teaching an improvement in corrosion resistance by a slight increase in the nickel content of the deposited alloy, have been forthcoming. Moreover, improvements in electroplate uniformity and further corrosion improvement by nickel priming have been accomplished as disclosed in U.S. Pat. No. 4,282,073. Also, the alloy plating may be further coated with a metallic zinc sacrificial layer, as disclosed in U.S. Pat. No. 4,314,893.

In some cases with substrates protected with zinc-plated layers it has been proposed to subsequently treat the surface with a chromate conversion coating or passivating film, as has been shown in Japanese Patent Disclosure No.: Showa 57-174469, or U.S. Pat. No. 4,216,272. Or to treat the zinc with a chrome ester cover layer such as taught in Japanese Patent Disclosure No.: Showa 56-113387.

It has also been known to protect steel surfaces against corrosion by using coating compositions that contain a hexavalent-chromium-providing substance as well as further containing a finely divided metal. For example, U.S. Pat. No. 3,687,739 discloses the preparation of a treated metal surface wherein such treatment includes application of a composition containing, among other constituents but as critical ingredients, chromic acid and a particulate metal. As has been disclosed in U.S. Pat. No. 3,671,331 the metals of the substrate for protection are advantageously metals from copper through zinc, inclusive, on the electromotive force series, as well as alloys of such metals wherein such metals are present in major amount. After the chromium containing bonding compositions are applied to such metal substrate, they are most always topcoated with a weldable primer topcoat composition. Such topcoats may then be cured by elevated temperature baking. It has also been known to coat zinc plated steel, typically in sheet form, with weldable zinc rich primers. Thus, in U.S. Pat. No. 4,079,163 it is shown to coat weldable primer over chromate treated galvanized steel.

It would however be further desirable to protect ferrous metals in corrosive environments, such as presented by metal composites wherein dissimilar metallic surfaces are in contact, by extending even further the corrosion resistance by coating technique prior to composite formation. It would be also desirable to provide the resulting coated article with a wide variety of worthwhile characteristics. Exemplary of these characteristics before composite formation would be coating adhesion during metal forming operation. During composite formation, such characteristics would include retention of weldability where the coated substrate would otherwise be weldable. It would be well to be able to provide coating procedures tailored to fast, economical operations, especially for the coating of steel in coil form, so as to provide an eventual composite product useful for example in the automotive industry.

SUMMARY OF THE INVENTION

It has been found possible to provide a metal composite of outstanding corrosion resistance. In addition to outstanding corrosion resistance, the composite can retain substrate weldability and formability, while further enhancing weatherability. Moreover, with newly developed high-strength, low-alloy steels, such characteristics can be achieved in straightforward, energy-efficient, low-temperature coating operation which need not be deleterious to the inherent strain characteristics of the substrate metal. The resulting metal composite article, e.g., continuously annealed and coated steel with enhanced resistance to corrosion attack as well as further desirable characteristics, e.g., weldability and formability in composite formation, can be achieved in fast, economical operation and is of particular interest for automotive use.

In one aspect, the present invention is directed to a metal composite containing metals in contact, dissimilar by substrate composition or surface character, the composite having enhanced corrosion resistance by having for at least one of the metals in contact, a coating composite comprising a metallic undercoating layer, a metallic zinc layer on such undercoating layer and a heat-curable, substantially resin free topcoat layer from composition curable to a water resistant protective coating, the topcoat layer containing above 10 milligrams per square foot of coated metallic zinc layer of chromium, as chromium, in non-elemental form, and with there being more than about 20 weight percent of such chromium as hexavalent chromium, with the composition containing hexavalent-chromium-providing- substance in liquid medium.

In another aspect, the invention is directed to the method of preparing the novel composite.

DESCRIPTION OF THE PREFERRED EMBODIMENTS

The metal substrates contemplated by the present invention are exemplified by any of the metal substrates to which a metallic coating can be applied. For example, such metal substrates may be aluminum and its alloys, zinc and its alloys, copper and cupriferous, e.g., brass and bronze. Additionally, exemplary metal substrates include cadmium, titanium, nickel, and its alloys, tin, lead, chromium, magnesium and alloys thereof, and for weldability, preferably a ferrous metal substrate such as iron, stainless steel, or steel such as cold rolled steel or hot rolled and pickled steel. All of these for convenience are usually referred to herein simply as the "substrate".

Prior to metal composite formation, one of the metals will be prepared with a metallic undercoating. For example, a thin metallic nickel layer, or nickel "strike" layer, such as on the order of about one micron thickness or so, may be deposited before a the zinc coating. Or a copper undercoating or "flash" coating layer can precede the zinc layer. Other metallic undercoating layers can include cobalt and tin. Such metallic undercoatings will preferably be present on the substrate in a thickness not exceeding about one micron, and usually less, e.g., 0.1 micron or less, but more typically within the range from 0.2 to 0.7 micron. After application of the metallic undercoating layer it can be subjected to heating prior to undercoating. For example, a nickel strike on a ferrous metal substrate might be annealed prior to zinc coating.

It is to be understood that pretreatments of the substrate prior to undercoating can be useful. These may include etching of the substrate metal, such as to enhance coating adhesion to the substrate, preferably metallic undercoat adhesion to the substrate. It is further to be understood that the metallic undercoating layer might be an alloy, although for economical and efficient composite preparation, such is not preferred, that is, such preferred undercoating layer does not contain other metals except in trace amounts not exceeding about0.5 weight percent of the undercoating of any one other metal.

Moreover, although strike or flash coatings are preferred, the metallic undercoating layer may be present on the metal substrate in an amount up to about 25 microns thickness. Greater amounts can be uneconomical as well as leading to thick coatings which may be deleteriously brittle. Generally, such a metallic undercoating layer will be present in a thickness on the metal substrate of below about 10 microns or less, i.e., have a thickness of from 1 to about 10 microns. The method of applying the metallic undercoating layer will in general be determined by the economy of application for the particular undercoating selected. For example, with a nickel strike undercoating, such may be applied by electrolytic application. Electroless deposition, flame spraying and the like for the undercoatings is also contemplated.

The metallic zinc layer is then deposited on the metallic undercoating layer, thereby forming a metallic laminate protective composite. Ordinarily the zinc will be applied by electrodeposition and have a coating weight on the order of about 10 to about 50 grams per square meter of coated metallic undercoating. However, other deposition techniques may be used, e.g., dipping and spraying applications. It is to be further understood that as is the practice in zinc application, the resulting coating may contain a very minor amount of metallic alloying elements, e.g., a few percent of aluminum. Advantageously however, such zinc layer contains less than about a few weight percent total of alloying elements. It is to be understood that whereas there may be applied one metallic undercoating layer plus metallic zinc layer laminate, several such laminates, e.g., two to four or more such laminates may be applied, particularly in continuous plating applications using fast plating technique, such as from several tanks in series. Then the final, i.e., uppermost, metallic zinc layer is topcoated.

Of particular interest as hexavalent-chromium-containing topcoatings for the present invention are bonding coatings. Those that are preferred may contain succinic acid and other dicarboxylic acids of up to 14 carbon atoms as the reducing agents, as has been disclosed in U.S. Pat. No. 3,382,081. Such acids with the exception of succinic may be used alone, or these acids can be used in mixture or in mixture with other organic substances exemplified by aspartic acid, acrylamide or succinimide. Additionally useful combinations that are particularly contemplated are combinations of mono-, tri- or polycarboxylic acids in combination with additional organic substances as has been taught in U.S. Pat. No. 3,519,501. Also of particular interest are the teachings in regard to reducing agents, that may be acidic in nature, and have been disclosed in U.S. Pat. Nos. 3,535,166 and 3,535,167. Of further particular interest are glycols and glycol-ethers and many representative compounds have been shown in U.S. Pat. No. 3,679,493.

Other compounds may be present in the hexavalent-chromium-containing liquid composition, but, even in combination, are present in very minor amounts so as not to deleteriously affect the coating integrity, e.g., with respect to weldability. Thus, such compositions should contain 0–40 grams per liter of resin, i.e., are substantially resin-free. Since the role of the chromium-providing-substance is partially adhesion, such coating compositions are preferably resin-free. Moreover the total of phosphorous compounds should be minute so as not to deleteriously interfere with coating weldability. Preferably the compositions contain no phosphorous compounds, i.e., are phosphate-free. The other compounds that may be present include inorganic salts and acids as well as organic substances, often typically employed in the metal coating art for imparting some corrosion resistance or enhancement in corrosion resistance for metal surfaces. Such materials include zinc chloride, magnesium chloride, various chromates, e.g., strontium chromate, molybdates, glutamic acid, zinc nitrate, and polyacrylic acid and these are most usually employed in the liquid composition in amount totaling less than about 15 grams per liter.

The preferred topcoatings contain a particulate metal such as aluminum, manganese, zinc and magnesium. These particulate metals have been disclosed as useful in bonding coating compositions containing a hexavalent-chromium-providing substance and reducing agent therefor in liquid medium, such as disclosed in U.S. Pat. No. 3,671,331.

Substantially all of the topcoating compositions are simply water based, ostensibly for economy. But for additional or alternative substances, to supply the liquid medium at least for some of these compositions, there have been taught, as in U.S. Pat. No. 3,437,531, blends of chlorinated hydrocarbons and a tertiary alcohol including tertiary butyl alcohol as well as alcohols other than tertiary butyl alcohol. It would appear then in the selection of the liquid medium that economy is of major importance and thus such medium would most always contain readily commercially available liquids.

Chromium may typically be present in the hexavalent state by incorporation into the topcoating compositions as chromic acid or dichromate salts or the like. During the curing of the applied coatings composition, the metal is susceptible to valency reduction to a lower valence state. Such reduction is generally enhanced by the reducing agent in the composition, when present. For enhanced corrosion resistance the resulting coating will provide at least about 20 percent hexavalent chromium, basis total topcoat chromium, up to about 50 percent of hexavalent chromium, basis total topcoat chromium, up to about 50 percent of hexavalent chromium. More typically from about 20 to about 40 percent of the topcoating chromium will be in the hexavalent state after curing of the topcoat.

When the topcoating is first established, the applied coating will be non-water resistant. The topcoatings contemplated as useful in the present invention are those which will cure at generally moderate elevated temperature. They can be typically cured by forced heating at such moderately elevated temperature. In general, the curing conditions are temperatures below 550° F. air temperature, and at such temperature, for times of less than about 2 minutes. However, lower temperatures such as 300°-500° F., with curing times, such as 0.5-1.5 minutes are more typically used. Hence, the most serviceable topcoats lend themselves to fast and economical overall coating operation, such as will be useful with exemplary steel substrates in strip or coil form.

The resulting weight of the topcoating on the metal substrate may vary to a considerable degree, but will always be present in an amount supplying greater than 10 milligrams per square foot of chromium, measured as chromium and not as $CrO_3$. A lesser amount will not lead to desirably enhanced corrosion resistance. Advantageously, greater than about 15 milligrams per square foot of coated substrate of chromium will be present for best corrosion resistance, while most typically between about 20-500 milligrams per square foot of chromium, always expressed as chromium and not $CrO_3$, will be present. Also, when particulate metal is present the coated metal substrate should contain between about 50 and about 5,000 milligrams per square foot of pulverulent metal and preferably have a weight ratio of chromium to pulverulent metal of not substantially above about 0.5:1.

After application of the topcoating, it is preferable not to further topcoat prior to composite formation. This provides the most enhanced corrosion resistance for the composite. In preparing the composite, usual metal bonding techniques can be applied, e.g., welding and adhesive bonding. Representative dissimilar metals that can be present include a metal with a coating composite as above described in contact with a steel such as cold rolled steel, or a plated steel such as electrogalvanized steel, or a surface treated steel such as chromized steel or the like.

The following example will serve to further illustrate the operation and advantages of the present invention. The example should not be considered, however, as a limitation upon the scope of the present invention.

PREPARATION OF TEST PARTS

Test parts are typically prepared for coating by first immersing in water which has incorporated therein 2 to 5 ounces of cleaning solution per gallon of water. The alkaline cleaning solution is a commercially available material of typically a relatively major amount by weight of sodium hydroxide with a relatively minor weight amount of a water-softening phosphate. The bath is maintained at a temperature of about 120° to 180° F. Thereafter, the test parts are scrubbed with a cleaning pad which is a porous, fibrous pad of synthetic fiber impregnated with an abrasive. After the cleaning treatment, the parts are rinsed with warm water and may be dried.

APPLICATION OF COATING TO TEST PARTS AND COATING WEIGHT

Clean parts are typically topcoated by dipping into coating composition, removing and draining excess composition therefrom, sometimes with a mild shaking action, and then immediately baking or air drying at room temperature until the coating is dry to the touch and then baking. Baking proceeds in a hot air convection oven at temperatures and with times as specified in the examples.

Coating weights for parts, generally expressed as a weight per unit of surface area, are typically determined by selecting a random sampling of parts of a known surface area and weighing the sample before coating. After the sample has been coated, it is reweighed and the coating weight per selected unit of surface area, most always presented as milligrams per square foot (mg./sq.ft.), is arrived at by straightforward calculation.

CORROSION RESISTANCE TEST (ASTM B117-73) AND RATING

Corrosion resistance of coated parts is measured by means of the standard salt spray (fog) test for paints and varnishes ASTM B117-73. In this test, the parts are placed in a chamber kept at constant temperature where they are exposed to a fine spray (fog) of a 5 percent salt solution for specified periods of time, rinsed in water and dried.

Prior to placing in the chamber, a portion of the test part is deformed, in the nature of a "dome", by first firmly positioning the part so that the subsequent dome portion corresponds to the circular die of the deforming apparatus. Thereafter, a piston with a ball bearing end is used to deform the portion of the test part through the die into the dome shape. The dome height is 0.30 inch. The extent of corrosion on the test parts is determined by inspecting only the dome and comparing parts one with another and all by visual inspection.

EXAMPLE

There is formulated, with blending, a topcoating composition containing 20 grams per liter of chromic acid, 3.3 grams per liter of succinic acid, 1.7 grams per liter of succinimide, 1.5 grams per liter of xanthan gum hydrophillic colloid, which is a heteropolysaccharide prepared from the bacteria specie *Xanthamonas camperstris* and has a molecular weight in excess 200,000. Additionally, the composition contains 1 milliliter of formalin, 7 grams per liter of zinc oxide, 120 grams per liter of zinc dust having an average particle size of about 5 microns and having all particles finer than 16 microns, and 1 drop per liter of a wetter which is a nonionic, modified polyethoxide adduct having a viscosity in centipoises at 25° C. of 180 and a density at 25° C. of 8.7 lbs. per gallon. After mixing all of these constituents, this undercoating composition is then ready for coating test panels.

The parts for testing are cold-rolled steel panels. A standard nickel plating bath of the Watts type is prepared. Normal current density for this type of bath is employed, i.e., 0.1-0.5 amps/in.$^2$ (asi). The nickel plated panels are removed, rinsed with deionized water and placed in a standard zinc chloride plating bath containing about 200-250 g/l of zinc chloride. The plating proceeds at room temperature with a standard current density of about 0.2-1 asi. The resulting zinc plated panels were removed from the bath, rinsed as before, and dried. The panels, including cold-rolled steel control panels, are topcoated, by dipping in the above described coating composition, removing and draining the excess composition therefrom. The topcoated panels are than baked up to 3 min. at 500° F. air temperature in a convection oven. The topcoating is judged to be of similar weight on test panels and is measured on the cold-rolled steel test panel to contain 27 mg/sq. ft. chromium, as chromium and 310 mg/sq. ft. of particulate zinc. Coated panels are subjected to the hereinabove described corrosion resistance test. Whereas panels with only the nickel-zinc laminate can be expected to show red rust in this testing in less than 120 hours, and for panels with the topcoat alone in about 40 hours, the combination of the laminate with the topcoat can extend to 480 test hours before first appearance of red rust. Such are thus judged to be most suitable for the formation of highly desirable, corrosion resistant metal composites.

What is claimed is:

1. A corrosion-resistant coated metal substrate having a coating including a metallic laminate protective composite containing adjacent layers of dissimilar metals, with said coating composite comprising:

(a) a metallic undercoating layer of a metal dissimilar from the metal of said substrate and free from other metals except in trace amounts;

(b) a metallic zinc layer on said undercoating layer and dissimilar from said undercoating metal; and, (c) a heat-curable, substantially resin free topcoat layer from composition curable to a water resistant protective coating, said topcoat layer containing from about 20 to about 500 milligrams per square foot of chromium, as chromium, in non-elemental form, and with there being more than about 20 weight percent of said chromium as hexavalent chromium, said composition containing hexavalent-chromium-providing-substance in liquid medium.

2. The coated metal substrate of claim 1 wherein said metal substrate is ferrous metal, and said ferrous metal is coated with a metallic undercoating selected from the group consisting of nickel, cobalt, tin and copper.

3. The coated metal substrate of claim 2 wherein said metallic undercoating is up to about one micron thick.

4. The coated metal substrate of claim 1 wherein said substrate metal is selected from the group consisting of ferrous metal and zinc-, nickel-, cadmium-, cobalt-, and chromium-containing alloys.

5. The coated metal substrate of claim 1 further characterized by having up to about 25 microns thickness of metallic undercoating layer.

6. The coated metal substrate of claim 5 wherein said metallic undercoating layer is from about 0.2 to about 10 microns thick.

7. The coated metal substrate of claim 1 further characterized by having a cured, water resistant topcoat layer containing more than about 20 weight percent, but less than about 50 weight percent, of said chromium in hexavalent form and said topcoat layer is applied as aqueous-based heat-curable, coating composition.

8. The coated metal substrate of claim 1 wherein said water resistant topcoat layer contains particulate metal.

9. The coated metal substrate of claim 8 wherein said particulate metal is selected from the group consisting of zinc, aluminum, manganese, magnesium, mixtures thereof and alloys of same.

10. The coated metal substrate of claim 8 further characterized by having said water resistant topcoat layer containing said particulate metal in an amount above about 50 milligrams per square foot of coated metallic zinc layer.

11. The coated metal substrate of claim 8 further characterized by having said water resistant topcoat layer containing up to about 5,000 milligrams per square foot of coated metallic zinc layer of said pulverulent metal and said topcoat layer further has a weight ratio of chromium, as chromium, to pulverulent metal of not substantially above about 0.5:1.

12. The coated metal substrate of claim 1 wherein said water resistant and substantially free resin free topcoat layer is further phosphate free.

13. The coated metal substrate of claim 1 wherein said topcoat layer contains at least one of said laminate metals in particulate form.

* * * * *